United States Patent [19]

Brown

[11] 4,320,268

[45] Mar. 16, 1982

[54] ILLUMINATED KEYBOARD FOR ELECTRONIC DEVICES AND THE LIKE

[75] Inventor: Robert E. Brown, Lynchburg, Va.

[73] Assignee: General Electric Company, Lynchburg, Va.

[21] Appl. No.: 123,105

[22] Filed: Feb. 19, 1980

[51] Int. Cl.[3] ..... H01H 13/70

[52] U.S. Cl. ..... 200/5 A; 200/314

[58] Field of Search ..... 348/712, 380, 381; 200/310, 313, 314, 5 A

[56] References Cited

U.S. PATENT DOCUMENTS

| | | | |
|---|---|---|---|
| 3,531,676 | 9/1970 | Robinson | 313/483 |
| 3,545,110 | 12/1970 | Coolbaugh et al. | 40/130 |
| 3,571,647 | 3/1971 | Robinson | 313/509 |
| 3,621,595 | 11/1971 | Coolbaugh et al. | 40/544 |
| 3,670,067 | 6/1972 | Coolbaugh et al. | 264/154 |
| 3,786,307 | 1/1974 | Robinson | 313/505 X |
| 3,883,887 | 5/1975 | Robinson | 357/2 |
| 3,967,084 | 6/1976 | Pounds | 200/275 |
| 4,042,439 | 8/1977 | Pounds | 156/292 |
| 4,056,701 | 11/1977 | Weber | 200/314 |
| 4,060,703 | 11/1977 | Everett | 200/310 |
| 4,085,306 | 4/1978 | Dunlap | 200/275 |
| 4,144,557 | 3/1979 | Kerr | 362/84 |
| 4,195,210 | 3/1980 | Pounds et al. | 200/159 A |

OTHER PUBLICATIONS

Electroluminescent (EL) Lighted Lamps, Astronics Corporation, Sales Literature, 2 pp.

Integrally Illuminated Panel Types III, IV, V & VI, Astronics Corporation, Sales Literature, 2 pp.

Electroluminescent (EL) Lighted Panels, Astronics Corporation, Sales Literature, 1 p.

Astrolites, Encapsulated EL Lamps, Astronics Corporation, Sales Literature, 1 p.

*Primary Examiner*—J. V. Truhe

*Assistant Examiner*—Morris Ginsburg

*Attorney, Agent, or Firm*—James J. Williams

[57] ABSTRACT

A keyboard is illuminated by an electroluminescent panel positioned between the keyboard push buttons and the switch contacts. The electroluminescent panel provides good illumination because of its proximity to the push buttons, and an actuator for each push button extends through the electroluminescent panel to insure positive operation of the respective switch contact.

7 Claims, 3 Drawing Figures

ILLUMINATED KEYBOARD FOR ELECTRONIC DEVICES AND THE LIKE

BACKGROUND OF THE INVENTION

My invention relates to a keyboard, and particularly to a keyboard that is illuminated by an electroluminescent panel.

Keyboards are used in many electronic applications such as calculators, telephones, or controls. In many of these applications, it is very desirable and in some cases essential that the keyboard be illuminated. For many years, the electronic industry has sought a uniformly illuminated keyboard that does not require relatively expensive and large light emitting diodes or incandescent lamps. Accordingly, a primary object of my invention is to provide a new and improved keyboard that is efficiently illuminated by an electroluminescent panel.

In many applications, the device requiring a keyboard is relatively small, so that the keyboard itself should also be relatively small. Accordingly, another object of my invention is to provide a new and improved keyboard that is relatively thin.

Another object of my invention is to provide a new and improved keyboard that is illuminated by an electroluminescent panel with a construction that permits the keyboard to be relatively thin.

Of course, reliable operation of the keyboard switch contacts is essential. Accordingly, another object of my invention is to provide a new and improved keyboard that is positive and reliable in its operation of the switch contacts.

A general object of my invention is to provide a new and improved keyboard that is relatively thin, uniformly illuminated, and reliable in operation.

SUMMARY OF THE INVENTION

Briefly, these and other objects are achieved in accordance with my invention by a keyboard having a push button, and electroluminescent panel behind or beneath the push button, and a switch contact preferably of the bubble or dome type behind or beneath the electroluminescent panel. The electroluminescent panel and switch contact are relatively thin, and the push button includes an extension or actuator which passes through an opening in the electroluminescent panel to engage the switch contact for positive operation. The push buttom can be made of relatively clear plastic that permits light from the electroluminescent panel to illuminate the push button. This illumination is improved or enhanced by the extension or actuator also being made of clear plastic, and contrast can be provided by surrounding the push button and enclosing the sides of the keyboard with an opaque material.

BRIEF DESCRIPTION OF THE DRAWING

The subject matter which I regard as my invention is particularly pointed out and distinctly claimed in the claims. The structure and operation of my invention, together with further objects and advantages, may be better understood from the following description given in connection with the accompanying drawing, in which:

DESCRIPTION OF THE PREFERRED EMBODIMENT

Figure 1:
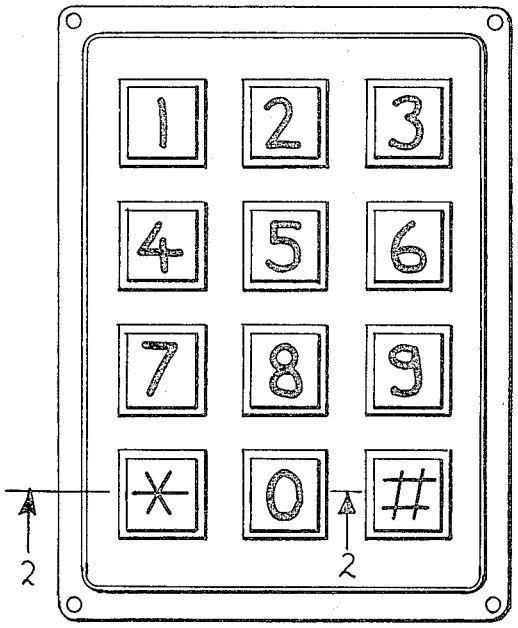
FIG. 1 shows a top plan view of an improved illuminated keyboard in accordance with my invention.
Figure 2:
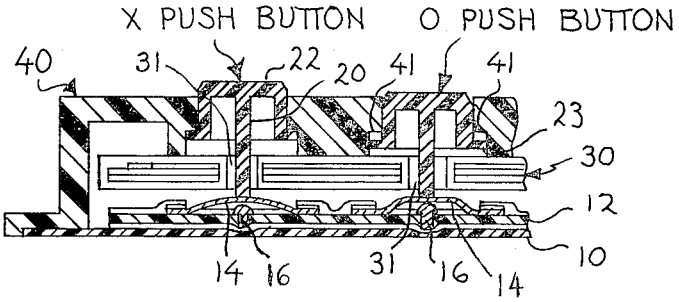
FIG. 2 an enlarged cross sectional view of my keyboard taken along the lines 2—2 of FIG. 1; and p

As an example of my improved illuminated keyboard, I show in FIG. 1 a keyboard with twelve push buttons having the respective designations shown. More or less push buttons can be provided in a keyboard in accordance with my invention, and these push buttons may be designed in any desired manner, depending upon the application for the push buttons. FIG. 2 shows an enlarged cross sectional view of my keyboard taken along the lines 2—2 of FIG. 1. My keyboard includes a bottom plate 10 made of any suitable, preferably insulating material. One or more switch contacts, preferably mounted on an insulating base 12, are provided on the bottom plate 10, there being one such switch contact for each of the push buttons utilized in my keyboard. Thus, a switch contact is positioned under the X push button, and another switch contact is positioned under the O push button. The X push button shown in the up or switch open position, and the O push button is shown in the down or switch closed position. These switch contacts are preferably of the type designated as a bubble, or dome, or clicker type switch contact. This type of switch contact is known in the art, and lends itself readily to relatively thin, printed circuit board type of construction. While only the switch contacts under the X and O push buttons have been shown, each switch contact preferably includes a metallic flexible dome or bubble 14 which may be circular, triangular, or rectangular in shape, and which has a convex depressable configuration facing upward. Each dome is secured on the base 12 around its edges or perimeter by any suitable means such as adhesive glass tape. Beneath this dome 14 on its concave side, is a metallic, stationary contact 16, which could be a printed circuit pattern in lieu of the contact 16 shown. The dome 14 and the contact 16 are insulated from each other and are connected preferably by printed circuit runs (on the base 12) to external terminals for providing the switching function to any type of circuit. As known in the art, each dome 14 may be separately brought out to a respective terminal, and each contact 16 may be brought out separately to a respective terminal. All of the domes may be connected to a common terminal, or alternativey, all of the contacts may be connected to a common terminal. As mentioned, the switch contacts associated with the X push button are in the open or disengaged position. The strength of each dome is sufficient to urge or hold an extension or actuator 20 of its respective push button in an upper position as shown by the X push button in FIG. 2. However, when a push button is depressed, such as shown for the O push button, its actuator or extension bends or flexes the dome and causes it to engage the fixed contact and close a suitable electrical circuit.

Positioned above all of the domes is electroluminescent panel generally designated 30. The panel 30 in FIG. 2 has been shown in enlarged form to illustrate its layer construction, but the layers have not been cross-sectioned so as to keep the drawing clear. This panel 30 is known in the art, and usually includes a flat glass or plastic plate on which is deposited a conductive film or metal foil which acts as one plate of a capacitor. Above this film is a capacitor dielectric material which contains an electroluminescent phosphor. Another film of transparent conductive material is deposited on top of the dielectric phosphor material, and the entire structure may be suitably enclosed. When an alternating current voltage of suitable magnitude and frequency is applied to or across the two conductive films, the dielectric phosphor material between them glows with a characteristic color, such as white, blue, or green. Such electroluminescent panels are known in the art, and a more detailed description is not believed necessary.

In accordance with my invention, I provide a respective hole or opening 31 completely through the panel 30 to accept and pass the extension or actuator 20 for each push button used or provided.

Figure 3:
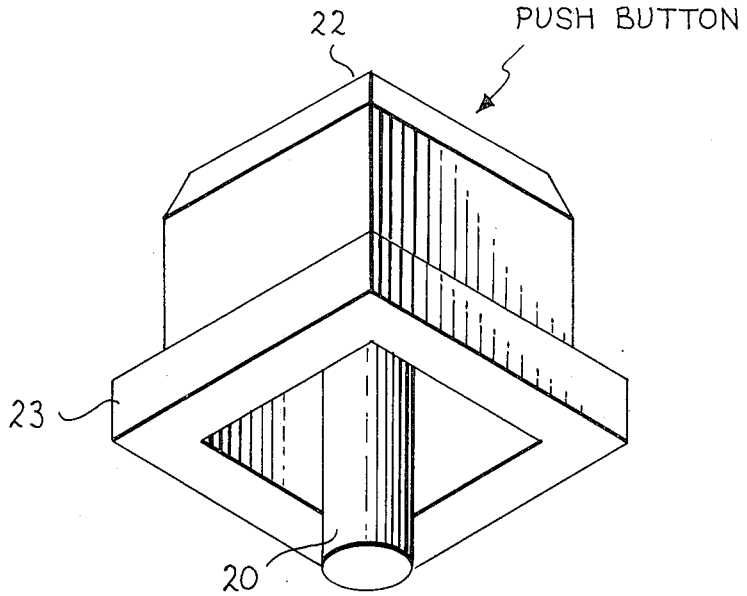
FIG. 3 shows a more detailed view of a push button for use in my keyboard of FIGS. 1 and 2.

Positioned above each hole 31 in the panel 30 is a push button preferably having the general configuration shown in FIGS. 1 and 2, and in the perspective view of FIG. 3. I prefer that the entire push button be molded or formed of a light transparent or clear plastic for reasons that will be explained. To save material and reduce weight, I prefer that the push buttons be hollowed out to some extent as shown. But if desired, the push buttons may be solid. Each push button is positioned so that its actuator 20 extends downward through a respective hole 31 in the panel 30 to engage the dome of a respective switch contact. The end of the actuator 20 may be rounded or suitably shaped so that it properly engages and operates the switch. The push buttons are arranged or configured so that they have a finger actuable portion 22 facing upward for operation by a user's finger. The portion 22 may be engraved with the desired number or designation, or may be provided with a transparent adhesive label having a printed number of designation. The shape and construction of the push buttons and the actuators can be modified to provide the desired light transmitting quality and intensity.

As mentioned earlier, the push buttons are held or urged in an upward or switch open position by the arch or dome of the switch contacts. A suitable insulating cover or retaining member 40 is positioned above the electroluminescent panel 30 and is provided with suitable holes or openings with an overhang 41 around the hole. This overhang 41 captures or retains an extension or flange 23 around each of each of the push buttons. By proper dimensioning of the cover or retaining member 40, the push buttons are held in captivity with the dome of each switch contact pushing upward on the actuator 20 to hold the push button as shown for the X push button. However, by also dimensioning the relative parts, the push button can be depressed to cause the actuator 20 to force or flex the dome to positively and reliably engage its respective fixed contact and close a circuit.

As also mentioned earlier, the push buttons are preferably made of a light transparent material such as clear plastic. When the elecroluminescent panel 30 is energized, its light is picked up and efficiently transmitted through the clear plastic forming each push button, and is also picked up and transmitted by the extension or actuator 20 which passes through a hole 31 in the panel 30. The panel 30 may be unitary in structure with a hole or opening for each push button actuator, or an individual panel 30 with a hole may be provided for each push button. In either case, the unitary panel or the individual panels may be easily provided and energized for illumination. The close proximity of the panel 30 to the push buttons and actuators serves to efficiently illuminate each push button, and provide a very visible structure. The visibility is enhanced by making the cover or retainer 40 of an opaque or dark material, so that all of the light from the panel 30 is caused to be transmitted into the clear plastic forming the push button.

It will thus be seen that I have provided a new and improved keyboard which utilizes relatively thin switch contacts, electroluminescent panels, and push buttons. Thus, my entire keyboard can be relatively thin. In addition, my electroluminescent panel provides a relatively efficient source of light to illuminate the push buttons, and does not require the relatively expensive light emitting diodes or incandescent lamps. Such diodes and lamps are also relatively difficult to manufacture and construct into a keyboard, since each one must be handled and energized independently. The entire electroluminescent panel can be energized with only two contacts. While I have shown only one embodiment of my invention, persons skilled in the art will appreciate the modifications that may be made. For example, other types of switch contacts may be used, although I prefer the dome type contact shown. The push buttons may have almost any configuration, such as being circular as opposed to square or rectangular. However, the push buttons do require the extension or actuator for the switch contacts. The extension or actuator can provide additional light transmitting qualities, and does provide positive switch action. Therefore, while my invention has been described with reference to a particular embodiment, it is to be understood that modifications may be made without departing from the spirit of the invention or from the scope of the claims.

What I claim as new and desired to secure by Letters Patent of the United States is:

1. An improved keyboard for electrical devices and the like comprising:

a. a switch having a first movable contact mechanically urged in a first direction, said first contact having means to be engaged for movement in a second direction opposite said first direction to engage a second contact and close said switch;

b. an electroluminescent panel positioned adjacent said switch in the vicinity of said means to be engaged;

c. and a push button positioned adjacent said electroluminescent panel on the side thereof away from said switch, said push button being formed of a relativey transparent material and having an actuator that extends from said push button through an opening in said electroluminescent panel for engaging said contact means to be engaged, whereby depression of said push button causes said first movable contact to move in said second direction and close said switch.

2. The improved keyboard switch of claim 1 wherein said push button is retained by a relatively light opaque material.

3. The improved keyboard switch of claim 1 or claim 2 wherein said first contact is of the dome type.

4. An improved switch arrangement comprising:

a. a push button formed of light transparent material, said push button having a finger actuable surface facing in a first direction and an elongated member extending from an opposite surface relative to said finger actuable surface and in a second direction opposite said first direction;

b. a relatively flat electroluminescent panel having one surface positioned adjacent said opposite surface of said push button for illuminating said push button, said electroluminescent panel having an opening with sides positioned around said elongated member, and having a second surface facing in said second direction;

c. and a switch mechanism positioned adjacent said second surface of said electroluminescent panel, said switch mechanism having operable means mechanically urged toward said elongated member for operation thereby.

5. The improved keyboard of claim 4, and further comprising a retaining portion positioned around said push button.

6. The improved keyboard of claim 4 or claim 5 wherein said switch mechanism is of the dome type having a convex contact member that can be depressed by said elongated member.

7. The improved keyboard of claim 6 wherein said switch mechanism has a second contact member positioned on the side of said convex contact member away from said elongated member, said second contact member being engaged by said convex contact member in response to said convex contact member being depressed.

* * * * *

UNITED STATES PATENT AND TRADEMARK OFFICE

CERTIFICATE OF CORRECTION

PATENT NO. : 4,320,268

DATED : March 16, 1982

INVENTOR(S) : Robert E. Brown

It is certified that error appears in the above-identified patent and that said Letters Patent is hereby corrected as shown below:

Column 1, line 68, cancel "p"
Column 2, line 47, cancel "alternativey" and insert --alternatively--.
Column 2, line 59, after "is" insert --an--.
Column 3, line 32, cancel "of" and insert --or--.
Column 4, line 46, cancel "relativey" and insert --relatively--.

Signed and Sealed this

*Third* Day of *August 1982*

[SEAL]

*Attest:*

GERALD J. MOSSINGHOFF

*Attesting Officer* *Commissioner of Patents and Trademarks*